United States Patent [19]

Carpentier et al.

[11] Patent Number: 4,466,659

[45] Date of Patent: Aug. 21, 1984

[54] SEAT BACK MOUNTED TRAY HOLDER

[76] Inventors: John R. Carpentier, No. 3 Graceland La., San Carlos, Calif. 94070; Ruth L. Turner, 320 Bloom Grade, Boulder Creek, Calif. 95006

[21] Appl. No.: 389,918

[22] Filed: Jun. 18, 1982

[51] Int. Cl.[3] ..... A47C 7/62

[52] U.S. Cl. ..... 297/191; 108/149; 224/318

[58] Field of Search ..... 150/35, 30, 31; 297/191, 193, 163, 146; 224/901, 269, 42.46 R, 258

[56] References Cited

U.S. PATENT DOCUMENTS

| | | | |
|---|---|---|---|
| 1,617,629 | 2/1927 | Gale | 150/31 |
| 2,196,341 | 4/1940 | Rush | 224/318 |
| 2,223,532 | 12/1940 | Sallop | 297/191 X |
| 2,817,566 | 12/1957 | Herman | 108/149 X |
| 2,881,039 | 4/1959 | Guzman | 297/163 |
| 3,088,771 | 5/1963 | Weigle | 297/191 X |
| 4,339,061 | 7/1982 | Dunn | 150/30 X |

FOREIGN PATENT DOCUMENTS

| | | | |
|---|---|---|---|
| 825141 | 11/1937 | France | 297/183 |
| 1567682 | 5/1969 | France | 297/191 |
| 393227 | 6/1933 | United Kingdom | 297/191 |

*Primary Examiner*—James T. McCall
*Attorney, Agent, or Firm*—Henry M. Stanley

[57] ABSTRACT

A folding tray holder for attachment to the rear of a stadium seat has hook like members on each side thereof which engage upright seat supports on each side of the seat and support the holder on the back of the seat. The holder has a rigid planar member in a bottom panel which may be folded upward from a supporting position when emptied to a stowed position to allow persons to pass along the aisle. The holder may be secured in the folded or stowed position and has a shoulder strap for carrying when removed from the seat back.

20 Claims, 7 Drawing Figures fig_1
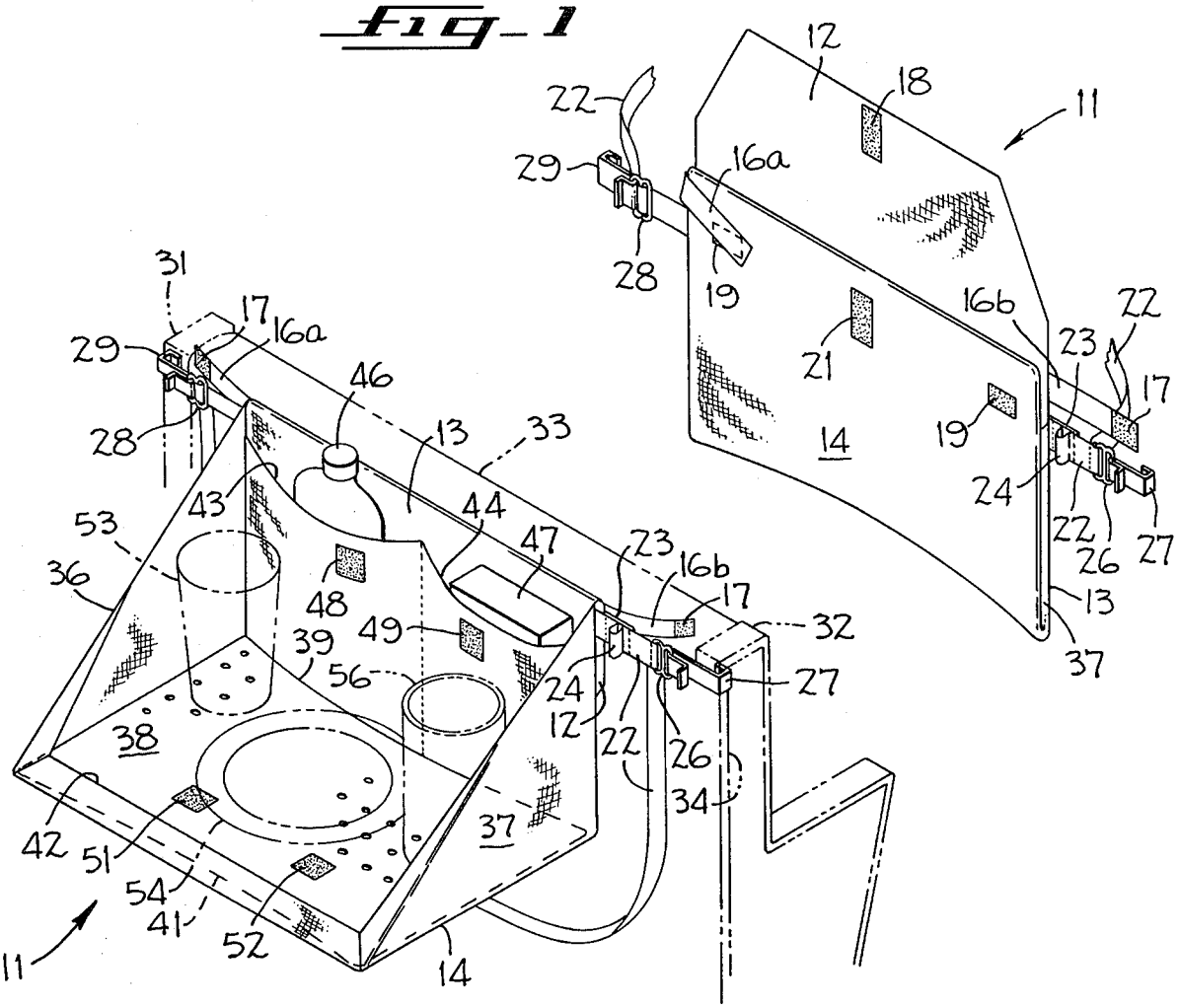
fig_2
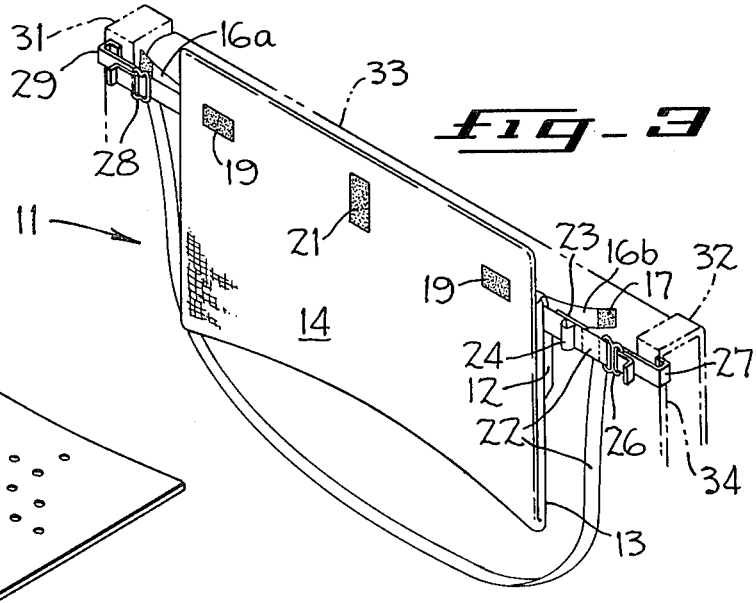
fig_3
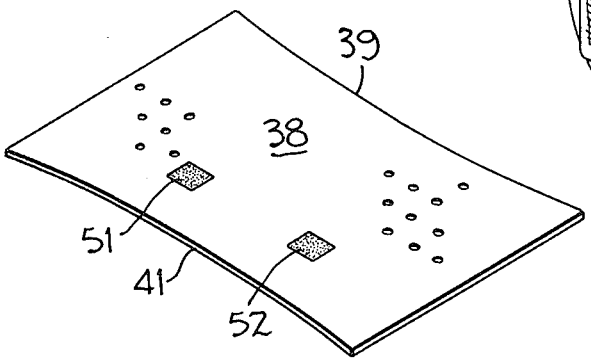
fig_4

SEAT BACK MOUNTED TRAY HOLDER

BACKGROUND OF THE INVENTION

1. Field of the Invention

This invention is directed toward apparatus suspended from a seat back for holding food and drink, and more particularly to such apparatus which is collapsible and portable.

2. Description of the Prior Art

In theaters and sports stadiums rows of seats are fixed in place so that spectators seated therein may observe the performance or sports event. Refreshments are often enjoyed by the spectators including food and drink of various types. Trays have been known to be carried on the lap of a person sitting in one of the seats. When another person wishes to traverse the row a lap mounted tray must be lifted by the person using the tray and held in an out of the way position to clear the row while the person passes. As a consequence the person occupying the seat must now resettle with the tray back on his or her lap, running the risk of spilling the refreshments and usually causing a distraction to those persons in the immediately surrounding seats. As a consequence, most persons attending performances or sporting events where food and drink is allowed resort to carrying refreshments in their hands at considerable personal inconvenience.

SUMMARY OF THE INVENTION

In one aspect of the invention a seat back mounted tray holder is provided for use in conjunction with a seat positioned to the front of the user of the tray holder, wherein the seats are of a type having a seat back-rest member which extends between two spaced upright seat support members. The tray holder includes a back portion and a bottom portion hinged along one side thereof to the back portion and adapted to support a tray for holding refreshments and the like. Opposing folding end portions extend between and are attached to the adjacent ends of the back and bottom portions. The end portions operate to limit the angular departure between the back and bottom portions as they move in hinged relationship with one another. Means is connected at each end of the back portion for attaching the back portion to the upright seat support members, whereby the bottom portion may be positioned between a substantially horizontal tray supporting position when the end portions are extended and a stowed position alongside the back portion when the end portions are in a folded condition.

In accordance with another aspect of the invention a seat back mountable and collapsible tray support is adapted to be releasably attached to the rear side of a stadium seat, wherein the seat has a pair of upright seat support members and a seat back-rest extending between the uprights. The tray holder includes a back panel, means disposed between the ends of the back panel and adjacent ones of the upright seat supports for attaching and supporting the back panel adjacent to the seat back. A bottom panel is attached along one edge thereof to one edge of the back panel so that the bottom panel may be pivoted between a stowed position adjacent one surface of the back panel and a tray supporting position removed therefrom. Means is disposed between the back and bottom panels for limiting the pivoting therebetween to the tray supporting position.

BRIEF DESCRIPTION OF THE DRAWINGS

FIG. 1 is a perspective view of the tray holder of the present invention with a top flap open.

FIG. 2 is a perspective view of the tray holder of the present invention in a tray holding position on a seat back.

FIG. 3 is a perspective view of the tray holder of the present invention in a stowed position on a seat back.

FIG. 4 is a perspective view of a rigid supporting member in the tray holder of the present invention.

DESCRIPTION OF THE PREFERRED EMBODIMENT

Figure 5:
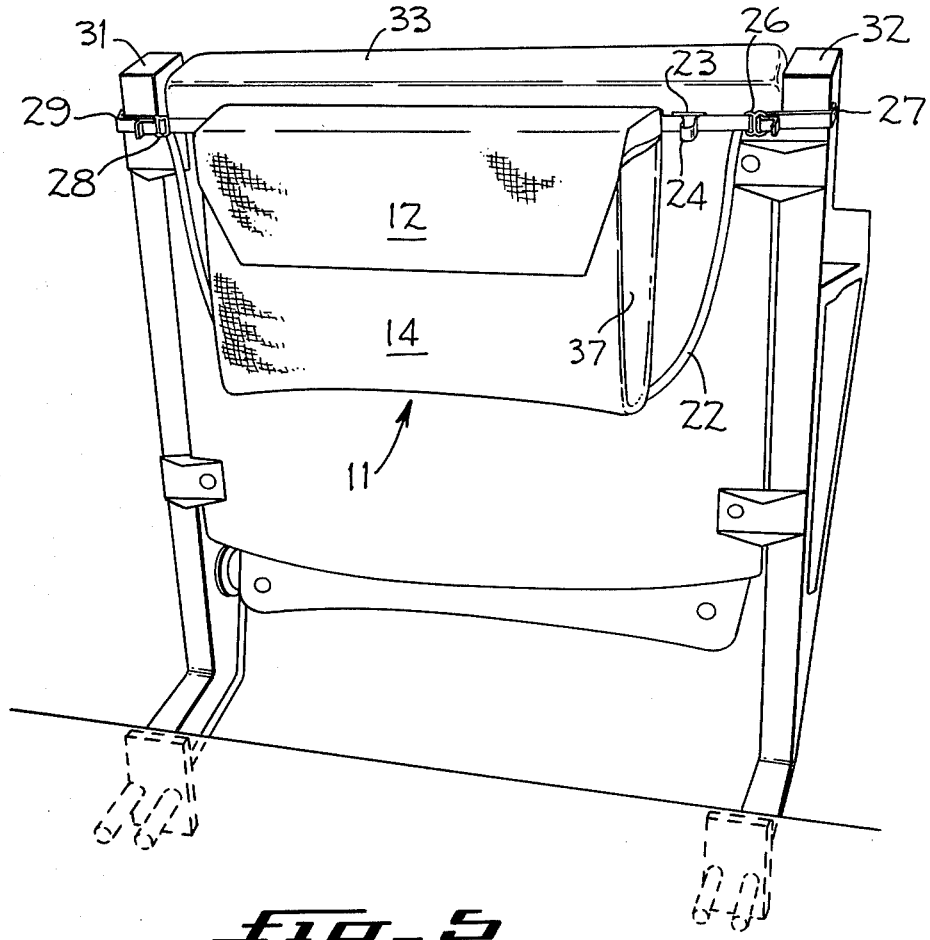
FIG. 5 is a perspective view of the tray holder of the present invention in a secured condition on the back of a stadium seat.

As mentioned hereinbefore theaters and stadiums wherein performances and sporting events are presented generally have rows of seats fixed to the theater or stadium floor wherein there are aisleways providing passage across the seat rows and also passageways along the seat rows to provide access to the seats for the observers of the performance or sporting event. The seats generally have support portions which are attached between spaced upright seat support members in a fashion so that the seat support portions may be pivoted upwardly to allow passage of persons along the row. In the event a person wishes to pass along the row when some of the seats are occupied, the row occupants may then stand and swivel their seats upwardly to allow the person to pass between them and the back of the seat in the adjacent forward row. The upright seat support members also have extended therebetween a seat back-rest member so that the seat occupants may relax rearwardly in their seats.

Since the space between the seat rows is generally relatively limited, any structure attached to the back of the seat immediately in front for the purpose of supporting refreshments and the like must be readily removable so that is affords no interference with those who wish to pass along the rows. A portable collapsible tray support 11 for holding refreshments in this type of environment is shown in FIG. 1. A top flap 12 is shown in an open condition attached along the upper edge of a back panel 13, one end of which only may be seen in FIG. 1. A bottom panel 14 is attached along the lower edge of the back panel so that the bottom panel may be pivoted either into a stowed position alongside the back panel as seen in FIG. 1 or into a tray supporting position angularly displaced from the back panel as best shown in FIG. 2. It may also be seen in FIG. 1 that a pair of tabs **16*a* and 16*b* are attached to the upper portion of the back panel at opposite ends thereof on which is fixed some fastening means such as snaps or the fastener known by the trade name "Velcro" identified as item 17. A Velcro fastener 18 is also seen centrally located on the top flap 12. Patches 19 and 21 are affixed to the outer surface of the bottom panel 14 in position to be contacted by the patches 17 and 18 on the tabs 16*a*/16*b* and top flap 12 respectively. In this fashion, when the bottom panel is pivoted to lie alongside the back panel and the tabs 16*a*/16*b* are brought around the ends of the bottom panel and the top flap 12** is dropped down to overlie the bottom panel, the tray holder is in a closed carrying condition as best seen with reference to FIG. 6 of the drawings.

Figure 6:
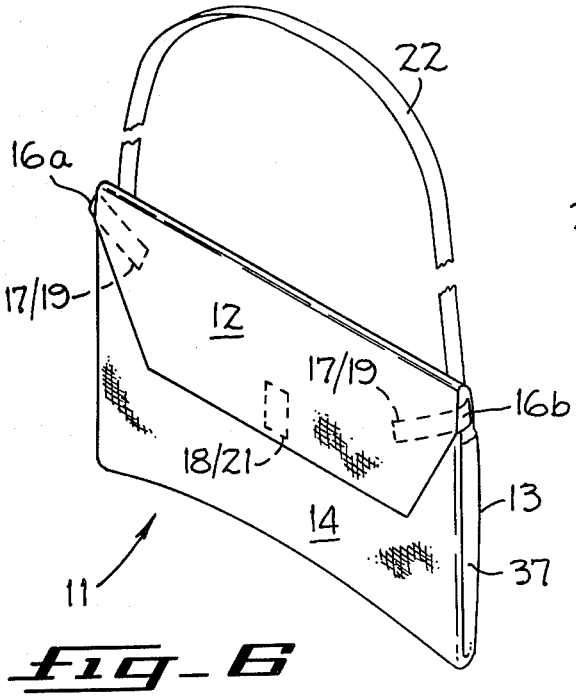
FIG. 6 is a front perspective view of the tray holder of the present invention in a secured carrying condition.
Figure 7:
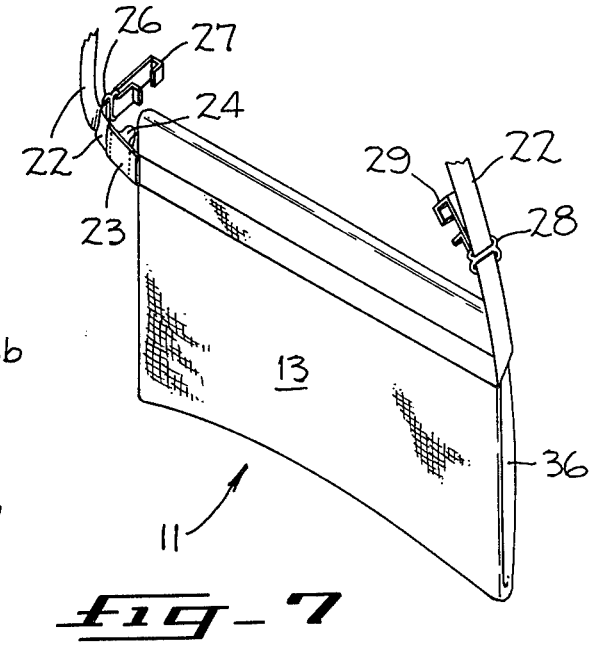
FIG. 7 is a rear perspective view of the tray holder of the present invention in a secured carrying condition.

Also with reference to FIG. 1 it may be seen that a strap 22 is attached to the back panel 13 (as best seen in FIG. 7) which extends from each end of the back panel near the upper portion thereof. On one extension of the strap 22 (the right side of the view of FIG. 1) the strap has a loop 24 formed therein with a section of elastic material 23 bridging the loop 24. In this fashion some tension may be placed in that portion of the strap 22 and the tension will be retained by the elastic section 23. A double eyed buckle 26 is sewn in fixed position along the length of the strap 22 as shown. The strap 22 is continuous from one side of the back panel 13 to the other side thereof as best seen in FIG. 6. The second eye of the double eyed buckle receives a hook 27 which may be formed of metal or plastic or any other appropriate durable substance.

A second double eyed buckle 28 is placed on the strap 22 as it extends from the opposite side of the back panel 13 so that the buckle may be adjusted in position along the length of the strap. Another hook 29, similar to the hook 27, is received through the outer eye of the buckle 28. In this fashion the position of the hook 29 may be adjusted relative to the adjacent end of the back panel 13.

Turning now to FIG. 3 it may be seen that the top flap 12 is shown detached from the fastener 21. In like manner the fasteners 17 on the tabs 16*a* and 16*b* are detached from the fasteners 19 on the bottom panel and the top flap is allowed to fall down alongside the back panel 13 as seen in FIG. 3. A pair of spaced upright seat support members 31 and 32 have a seat back-rest member 33 extending therebetween. These seat support members are often attached at the bottom end to the face of a step in the floor as seen in phantom lines in FIG. 5. The seat support members have a channel extending along the outer surface thereof which is bounded near the upper end of the channel by a lip 34. The hooks 27 and 29 are adapted to engage the lips 34 on the upright seat support members so that the free end of the hooks enter the aforementioned channels therein. The double eyed buckle 28 is adjusted along the length of the strap 22 to a point such that some tension is placed in the elastic section 23 bridging the loop 24 at the opposite end of the strap 22. In this fashion the back panel 13 is held in vertical position relative to the upright seat support members 31 and 32 in a position adjacent to the rear surface of the seat back-rest member 33. The strap 22 is allowed to fall downwardly in an out of the way position and the bottom panel 14 is then allowed to drop downwardly about the hinged connection between the back and bottom portions along the lower edge of the back portion. The position thus taken is best shown in FIG. 2.

When the bottom portion 14 is allowed to pivot away from its position alongside the back portion 13, a pair of folding end panels 36 and 37 come into view as seen in FIG. 2. The folding end panels are attached along one edge to one end of the back panel and along an adjacent edge to the adjacent end of the bottom panel. The folding end panels in FIG. 2 are seen as being somewhat triangular in shape and as being of some flexible fabric like material. It is also envisioned that the end panels could be cords extending between the upper corners of the back panel and the outermost corners of the bottom panel. Other equally utilitarian structural elements are envisioned as useful for the purpose served by the folding end panels 36 and 37 as seen in FIG. 2. The function of the end panels is to limit the angular movement between the back and bottom panels to the opened tray supporting position as depicted in FIG. 2.

Also in view when the tray holder is in the open tray supporting position is a stiffening member 38 which is substantially planar and which is seen in FIG. 4. It is also envisioned that the bottom panel 14 could have sufficient stiffness to perform the function of the planar member 38 by itself. The seat back-rest member 33 has a convex curved rear surface. Therefore the edge of the planar member 38 is somewhat curved as at 39 to substantially conform to the rear surface of the back-rest member. The line along the hinged junction between the back and bottom panels 13 and 14 respectively also takes the shape shown by the curved edge 39. The opposite edge 41 of the planar member (FIG. 4) may also be curved in the event some portion of the seat back-rest member must be cleared by the center portion of the bottom panel 14 when the tray holder is in the stowed position as seen in FIG. 3. A slightly raised portion 42 may be added to the outer edge of the bottom panel 14 to assist in retaining objects on the bottom panel (and the planar member 38) when the tray holder is in the opened or tray supporting position as seen in FIG. 2.

With reference further to FIG. 2, a pair of pockets 43 and 44 may be seen to be formed on the inside surface of the back panel 13. The pockets may be formed by sewing a rectangular piece of flexible material at the bottom and sides on the inside surface of the back panel so that such items as a flask 46 or a container 47 may be fitted therein. Additional fasteners (such as snaps or the material called by the trade name "Velcro" mentioned hereinbefore) 48 and 49 are attached to the outer surfaces of the pockets. Mating fasteners 51 and 52 are attached to the planar member 38 (or the inner surface of the bottom panel 14 when sufficient support is afforded thereby) so that when the bottom panel 14 is pivoted upwardly into the stowed position as seen in FIG. 3, the bottom panel is releasably retained in the stowed position to allow persons traveling along the rows to freely pass by the back of the seat.

In FIG. 2 with the tray holder shown in the opened or tray supporting position, certain articles are shown in phantom lines supported on the planar member 38 such as a glass 53, a plate 54 and a beverage can 56. Upon the approach of a person advancing along the row of seats into which the tray holder protrudes when in the open position, the seated person utilizing the tray holder lifts any articles such as the glass, plate and beverage can off of the bottom panel (preferably on a tray which is not shown) and merely pivots the bottom panel into the stowed position as seen in FIG. 3. The mating of the fasteners 48/51 and 49/52 retains the bottom panel in the stowed position until the person passes, after which the bottom panel is merely moved back into the tray holding position as seen in FIG. 2. The articles (and/or the tray) may be once again placed on the stiffening member in the bottom panel and no inconvenience has been worked on the person occupying the seat immediately ahead of the tray holder.

Upon completion of the performance or sporting event, the articles such as the glass 53, plate 54 and/or beverage can 56 (and the tray) may be removed from the planar member in the bottom panel 14 and the bottom panel may be urged to pivot in an upward direction to the stowed position shown in FIG. 3. The end panels 36 and 37 are urged inwardly during the movement of the bottom panel to the stowed position and the bottom panel is secured in that position by the fasteners 48/51 and 49/52. The top flap 12 is brought into a position as seen in FIG. 1 and the fasteners 17/19 on the tabs 16*a* and 16*b* are engaged. The top flap is dropped down to allow engagement between the fastener portions 18 and 21 (FIG. 1). The tray holder 11 then appears in the condition as shown in FIG. 5 wherein the flask 46 and the container 47 (FIG. 2) may be retained within the tray holder for transport if desired. The hook 27 may be grasped and moved outwardly against the tension in the elastic member 23 to clear the lip 34 on the upright seat support member 32 and removed therefrom. The opposite hook 29 may then be removed from the corresponding lip on the upright seat support member 31 and the strap 22 may be placed on the user's shoulder so that the tray holder may be transported in the carrying position as seen in FIG. 6. It should be noted with reference to FIG. 7 that the strap 22 may be attached along the length of the back panel 13 and near the upper edge thereof or the strap may merely have opposite ends thereof sewn along a limited length of the strap to the outer surface of the back panel 13.

Although the best mode contemplated for carrying out the present invention has been herein shown and described, it will be apparent that modification and variation may be made without departing from what is regarded to be the subject matter of the invention.

What is claimed is:

1. A seat back mounted tray holder, wherein a seat back-rest member extends between two spaced upright seat support members, comprising a back portion, a flexible bottom portion hinged along one side to said back portion and adapted to support a tray, a planar stiffening member formed to fit within said flexible bottom portion, opposing folding flexible end portions extending between and attached to adjacent ends of said back and bottom portions, said end portions operating when extended to limit the angular departure between said back and bottom portions, and means connected to each of the ends of said back portion for attaching said back portion to the upright seat support members, whereby said bottom portion may be positioned between a substantially horizontal tray supporting position with said end portions extended and a stowed position alongside said back portion with said end portions folded.

2. A seat back mounted tray holder as in claim 1 together with means for releasably retaining said bottom portion in said stowed position when alongside said back portion.

3. A seat back mounted tray holder, wherein a seat back-rest member extends between two spaced upright seat support members, comprising a back portion, a bottom portion hinged along one side to said back portion and adapted to support a tray, opposing folding end portions extending between and attached to adjacent ends of said back and bottom portions, said end portions operating to limit the angular departure between said back and bottom portions, and means connected to each of the ends of said back portion for attaching said back portion to the upright seat support members, whereby said bottom portion may be positioned between a substantially horizontal tray supporting position with said end portions extended and a stowed position alongside said back portion with said end portions folded, said bottom portion including a flexible outer cover and a rigid substantially planar member formed to fit within and to overlie said outer cover when in said tray supporting position.

4. A seat back mounted tray holder, wherein a seat back-rest member extends between two spaced upright seat support members, comprising a back portion, a bottom portion hinged along one side to said back portion and adapted to support a tray, opposing folding end portions extending between and attached to adjacent ends of said back and bottom portions, said end portions operating to limit the angular departure between said back and bottom portions, and means connected to each of the ends of said back portion for attaching said back portion to the upright seat support members, whereby said bottom portion may be positioned between a substantially horizontal tray supporting position with said end portions extended and a stowed position alongside said back portion with said end portions folded, said back portion including a substantially vertically disposed portion when said means for attaching is coupled to the upright seat support members, a top flap attached along the upper edge of said vertically disposed portion and means for securing said top flap to said bottom portion when said bottom portion is in said stowed position.

5. A seat back mounted tray holder as in claim 1 or 2 together with a strap disposed for carrying engagement when said bottom portion is in said stowed position.

6. A seat back mounted tray holder as in claim 1 wherein said means for attaching comprises a strap, means for adjusting the length of said strap, and a hook adapted to securely engage the upright seat support members.

7. A seat back mounted tray holder as in claim 6 wherein said means for adjusting on one end of said back portion comprises an elastic length in said strap.

8. A seat back mounted tray holder as in claim 6 wherein said means for adjusting on one end of said back portion comprises a double eye buckle.

9. A seat back mounted tray holder as in claim 1 wherein said back portion comprises a substantially vertically disposed portion when said means for attaching is coupled to the upright seat support members and at least one carrying pocket formed on the surface thereof which is disposed away from the seat back-rest.

10. A seat back mounted tray holder as in claim 1 wherein the seat back-rest rear surface is contoured and wherein said hinged one side of said bottom portion comprises a contoured edge adapted to substantially conform to the rear surface of the seat back-rest.

11. A seat back mountable and collapsible tray support adapted to releasably attach to the rear side of a stadium seat having a pair of upright seat support members and a seat back-rest extending therebetween comprising a back panel, means disposed between the ends of said back panel and adjacent ones of the upright seat supports for attaching and supporting said back panel adjacent to the seat back, a bottom panel attached along one edge thereof to one edge of said back panel so that said bottom panel may be pivoted between a stowed position adjacent one surface of said back panel and a tray supporting position removed therefrom, and means disposed between said back and bottom panels for limiting said pivoting therebetween to said tray supporting position, said means for limiting including a folding end panel attached to and extending between adjacent ends of said back and bottom panels and operating to support said bottom panel in a substantially horizontal plane when mounted on a seat in said tray supporting position.

12. A tray support as in claim 11 together with means for releasably retaining said bottom panel in said stowed position.

13. A seat back mountable and collapsible tray support adapted to releasably attach to the rear side of a stadium seat having a pair of upright seat support members and a seat back-rest extending therebetween comprising a back panel, means disposed between the ends of said back panel and adjacent ones of the upright seat supports for attaching and supporting said back panel adjacent to the seat back, a bottom panel attached along one edge thereof to one edge of said back panel so that said bottom panel may be pivoted between a stowed position adjacent one surface of said back panel and a tray supporting position removed therefrom, and means disposed between said back and bottom panels for limiting said pivoting therebetween to said tray supporting position, wherein said bottom panel comprises a flexible outer cover and a rigid support member disposed therein.

14. A seat back mountable and collapsible tray support adapted to releasably attach to the rear side of a stadium seat having a pair of upright seat support members and a seat back-rest extending therebetween comprising a back panel, means disposed between the ends of said back panel and adjacent ones of the upright seat supports for attaching and supporting said back panel adjacent to the seat back, a bottom panel attached along one edge thereof to one edge of said back panel so that said bottom panel may be pivoted between a stowed position adjacent one surface of said back panel and a tray supporting position removed therefrom, and means disposed between said back and bottom panels for limiting said pivoting therebetween to said tray supporting position, wherein a top flap is attached along an edge of said back panel opposite from said one edge, and means for attaching said top flap to said bottom panel when said bottom panel is in said stowed position.

15. A tray support as in claim 11 together with a carrying strap connected thereto for carrying engagement when in said stowed position.

16. A tray support as in claim 11 wherein said means for attaching and supporting comprises, a strap, means for adjusting said strap's length, and a hook adapted to engage the upright seat support members.

17. A tray support as in claim 16 wherein said means for adjusting comprises an elastic length on said strap.

18. A tray support as in claim 16 wherein said means for adjusting comprises a double eye buckle.

19. A tray support as in claim 11 wherein said back panel comprises at least one carrying pocket on the surface thereof remote from the seat back-rest.

20. A tray support as in claim 11 wherein the rear surface of the seat back-rest is contoured and wherein said one edge of said bottom panel has a contour substantially conforming to the contour of the rear surface of the seat back-rest.

* * * * *